US006099376A

United States Patent [19]

Singhal et al.

[11] Patent Number: 6,099,376

[45] Date of Patent: Aug. 8, 2000

[54] WEIGHTLESS TOY OBJECTS

[76] Inventors: Tara C Singhal; Devendra Singhal, both of P.O. Box 5075, Torrance, Calif. 90510

[21] Appl. No.: 09/123,220

[22] Filed: Jul. 27, 1998

[51] Int. Cl.[7] ..... A63H 27/10

[52] U.S. Cl. ..... 446/220; 446/225

[58] Field of Search ..... 244/31; 446/220, 446/221, 225

[56] References Cited

U.S. PATENT DOCUMENTS

| | | | |
|---|---|---|---|
| 810,690 | 1/1906 | Weiss | 244/33 |
| 1,519,436 | 12/1924 | Brock | 446/186 |
| 1,554,050 | 9/1925 | Slye | 446/223 |
| 1,755,161 | 4/1930 | Weimer | 446/223 |
| 1,858,460 | 5/1932 | Ranseen | 446/223 |
| 4,547,167 | 10/1985 | Bergmann | 446/220 |
| 4,931,028 | 6/1990 | Hawley | 446/225 |
| 4,934,986 | 6/1990 | Wallace | 446/220 X |
| 4,946,415 | 8/1990 | Huang | 446/225 |
| 5,045,011 | 9/1991 | Lovik | 446/46 |
| 5,088,952 | 2/1992 | Goldblatt | 446/220 |
| 5,123,869 | 6/1992 | Schipmann | 446/46 |
| 5,531,401 | 7/1996 | Newcomb | 446/225 X |
| 5,639,076 | 6/1997 | Cmiel et al. | 446/220 X |
| 5,765,831 | 6/1998 | Huffhines | 446/225 X |
| 5,893,790 | 4/1999 | Montgomery | 446/220 |

*Primary Examiner*—John A. Ricci
*Attorney, Agent, or Firm*—Steven G. Roeder

[57] ABSTRACT

Weightless Toy Objects where the upward buoyancy force of lighter than air gas inside the Toy Object body is carefully balanced against the gravitational weight of the Toy Object using a system of balance weights and orientation weights enabling the Toy Object to stay at a height and orientation in a space where it is deposited. The Toy Object can be in generic shapes, such as cube, cylinder and sphere for building larger weightless Toy Objects or in an identifiable shape such as cloud or airplane.

22 Claims, 5 Drawing Sheets

WEIGHTLESS TOY OBJECTS

BACKGROUND

Toys for adults and for children are fascinating, entertaining, and amusing and create a variety of playing fun. New toys are created by the toy industry when the existing toys no longer excite imagination and their sales decline. Every one is fascinated by weightlessness as seen in television pictures of astronauts and their personal objects floating effortlessly in space inside the shuttle. A new class of toys that would exhibit the characteristics of weightlessness would excite imagination and be fun to play with.

SUMMARY

A new concept in toys where the toy can stay at any height when left or deposited at that height inside a room space is disclosed. Toy objects that embody the characteristic of a weightless state would provide a new concept in toys. These toy objects are called Weightless Toy Objects, and are hereinafter referred to as "Toy Objects".

The Toy Objects can be of a generic shape such as a cube or cylinder, or have an identifiable shape or silhouette such as a cloud, airplane, etc. Generic shape Toy Objects may be used as building blocks to build larger Toy Objects in air space inside a room. For example, cubes can be stacked on top of each other vertically or attached to each other horizontally by a soft adhesive on the outside of the Toy Object. Such soft adhesive between two toy objects would allow them fu to stay attached but would allow then to be easily separated and thus would enable building a block of toy object made from individual toy objects.

The identifiable shape Toy Objects can be for just playing fun as individual Toy Objects or may be used to dress up larger Toy Objects built using generic building block Toy Objects. For example, a cloud Toy Object can be deposited in space while an airplane Toy Object can be used for floating it in the air and pushing it in the horizontal direction. A ball Toy Object can be used to tumble up or down in space. The Toy Objects stay in space at a height deposited by their owner for long periods of time. They can be pushed in a horizontal or vertical direction and tumbled up or down based on the force applied to them and then come to a stop when the force is dissipated very much like personal objects of astronauts as seen in television pictures. Children and adults may use them for many different kind of playing fun based on their imaginations.

The ability of the Toy Objects to stay at a height to which they are left or deposited is achieved by careful balancing of the upward force of lighter than air fluid inside the Toy Object and the weight of the Toy Object itself and without any external attachment such as a string. The weight of the Toy Object is a function of the density of the material used in the skin, the amount of the material used in the Toy Object and the weight of the lighter than air fluid such as helium gas inside the Toy Object. The Toy Object skin is preferably composed of an inner layer and an outer layer. The inner layer is gas impermeable and may be made of such material as polythene, a material commonly used in kitchen ziploc® bags, and other plastic bags. The outer layer is light weight, and may be puncture resistant, and substantially non-stretchable and may be made of foils commonly used in food packaging. Such an outer layer may be printed to create desired object appearance.

The upward force on the Toy Object is a function of the difference in the density of the lighter than air fluid such as helium gas and the air and the volume of displacement by the Toy Object. The downward force on the Toy Object is due to earth's gravitational force and is a function of the amount of the skin material in square inches used in the Toy Object and the per square inch weight of the material plus the weight of the fluid. The balancing of these two forces, the one of gravity and the other of buoyancy is carefully balanced to achieve the desired weightless state of the Toy Object. Using this principal, Toy Objects of any size from small to large can be made, as the volume of lighter than air fluid is proportional to the surface of the Toy Object.

To achieve close to perfect balance from merely substantial balance to assure that the Toy Object does not drift up or down over a period of time, the Toy Object's weight is balanced at typical air density and air temperature. A little more fluid is used so that the Toy Object has a slight upward drift. A system of Balance Weights is attached to the Toy Object to achieve close to perfect balance. The system of Balance Weights may consist of a series of strips each with a different size and thus weight, with a self adhesive to one side of the strip. The strips may be made of the same but thicker material as the outer layer of the Toy Object skin. The weight strips, preferably, are of one standard height and different width to create graduated weight strips. For example, the weights might be 100, 50, 20, 10, 5, 2, and 1 unit. The unit may be one milligram. These weight strips may be attached to the Toy Object, in any quantity necessary to achieve close to perfect balance and may be suitably adjusted to achieve balance in environments different than typical based on air density and air temperature. Once the careful balance is achieved, the Toy Objects stay at a height at which they are deposited.

A system of Orientation Weights may be attached to the Toy Object to maintain a desired orientation of the Toy Object in the air space. The Orientation Weight is, preferably, a disk shaped strip with self adhesive on one side. It may be in graduated circular sizes to represent graduated weights. The Orientation Weight strip when attached to the Toy Object would orient the Toy Object in the desired orientation. When the Orientation Weight is attached to one part of the Toy Object, that part becomes relatively heavier and gravitational force would make that part of the Toy Object the lowest in space and thus provide the desired orientation of the Toy Object in the space. When a Orientation Weight is used, the Balance Weight are also used to recreate perfect balance.

Toy Objects stay at the deposited height provided the air in the room is not unduly disturbed. If the air is disturbed, the Toy Objects gently oscillate or bob up and down around the deposited height very much like a cork in water bobs up and down from the ripple waves caused by disturbing the water surface. The cork or the Toy Object does not drift sideways. Therefore, the essential purpose of keeping Toy Objects at a deposited height is achieved. If air is not quiescent in the room, but has air currents present, then the Toy Object will move along with the air current.

The weightless Toy Object may come prefilled with a lighter than air fluid such as helium gas and permanently sealed at the factory and sold to the customer with a system of weights as described above. This is suitable for relatively small Toy Objects that can be conveniently packaged for sale. It may be desirable to use the weightless Toy Object concept on larger Toy Object which may be harder to package and transport conveniently. In such large Toy Objects a valve is created in the skin of the Toy Object that will enable the customer to fill his own helium gas. Such valves are commonly used in the industry for other inflatable objects and for mylar balloons. An example of such a valve is one disclosed in U.S. Pat. No. 4,917,646 and is incorporated herein by reference.

BRIEF DESCRIPTION OF THE DRAWINGS

These and other features, aspects and advantages of the present invention will become better understood with regard to the following description, appended claims and accompanying drawings where:

DETAILED DESCRIPTION OF THE INVENTION

Figure 1:
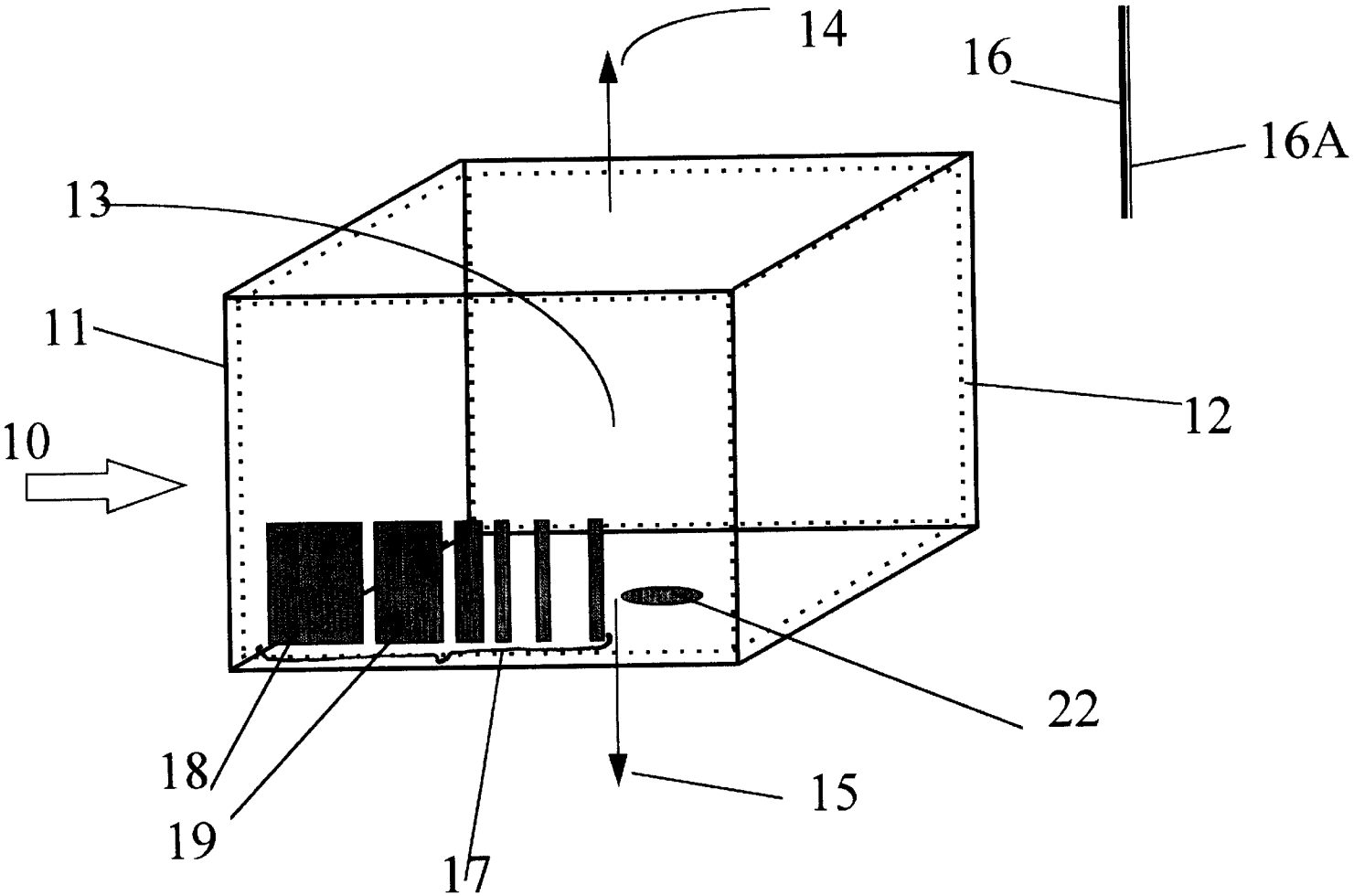
FIG. 1 is a version of the weightless Toy Object.

With respect to FIG. 1, the toy object (10) has an object body (11) including a sealable body chamber (12) and a fluid disposed in the body chamber (13), the fluid having a density which is less than the density of air; wherein the amount of the fluid in the body chamber is sufficient so that the upward buoyancy force (14) caused by the fluid on the body is substantially equal to the downward force (15) on the object body thereby allowing the object body to be suspended/float in the air without an external attachment to a fixed structure. The body suspends or floats by remaining at a height at which it is left or deposited. The fluid is preferably helium gas and may be other lighter than air fluid such as hydrogen. The sealable body chamber is made of a gas impermeable material (16A). The object body is made of a substantially non-stretchable material (16) enabling the Toy Object to retain its shape. The object body is also preferably made of a puncture resistant material.

Figure 2:
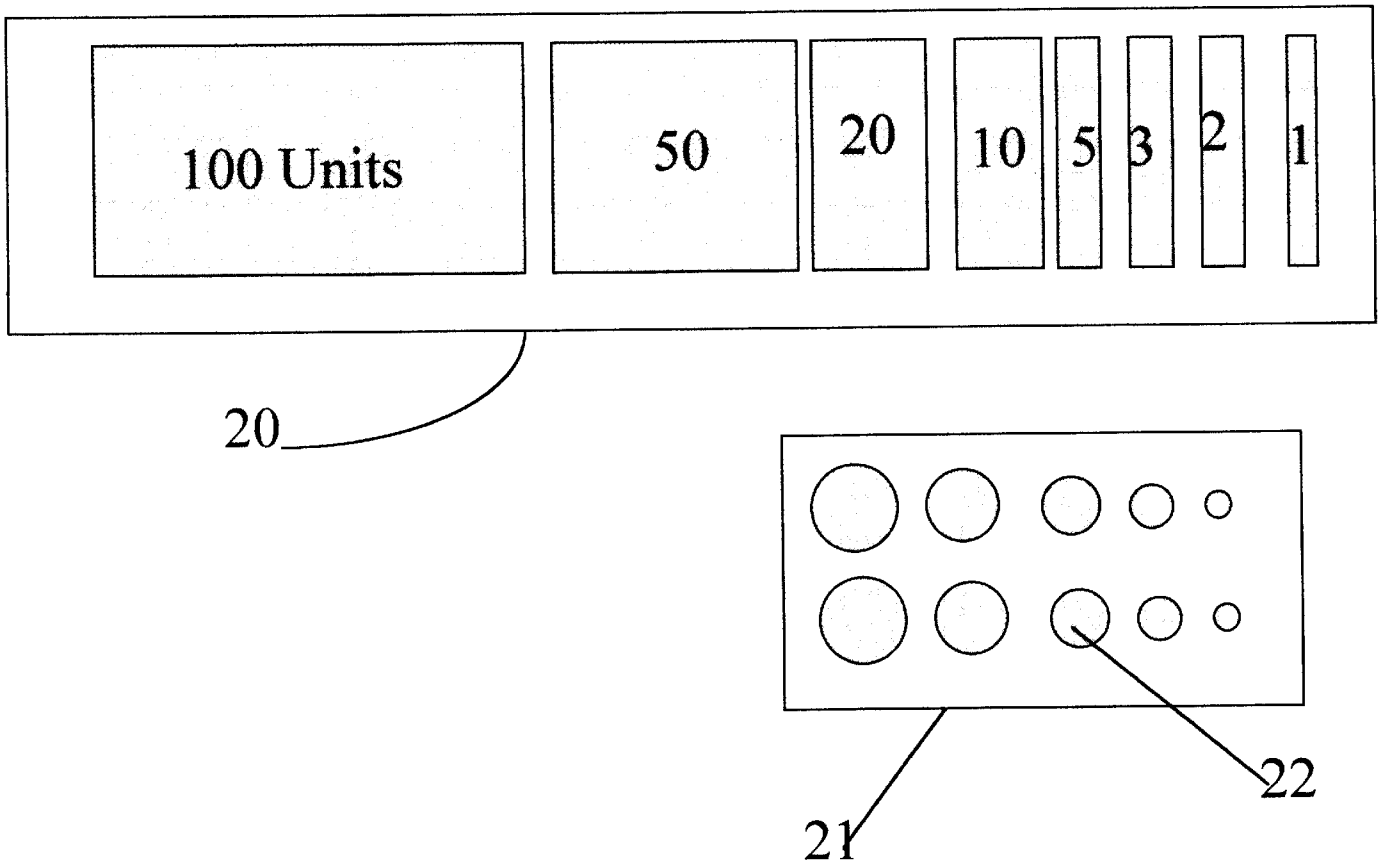
FIG. 2 is a version of the system of weights.
Figure 3A:
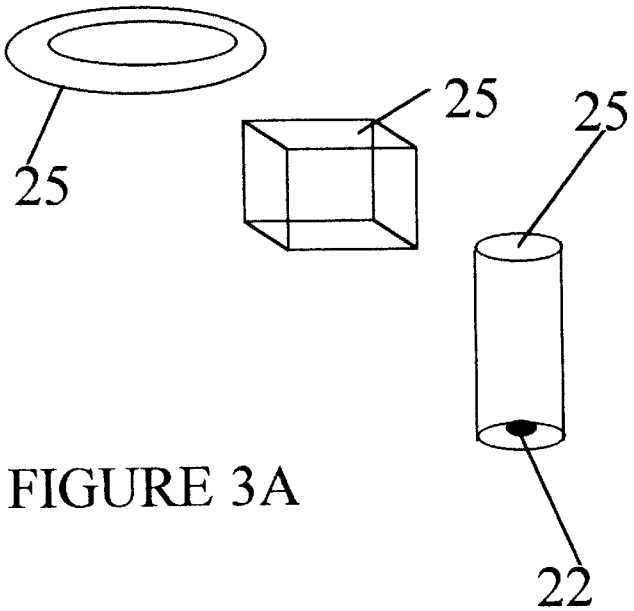
FIG. 3A is a version of the Toy Object Building Blocks.
Figure 3B:
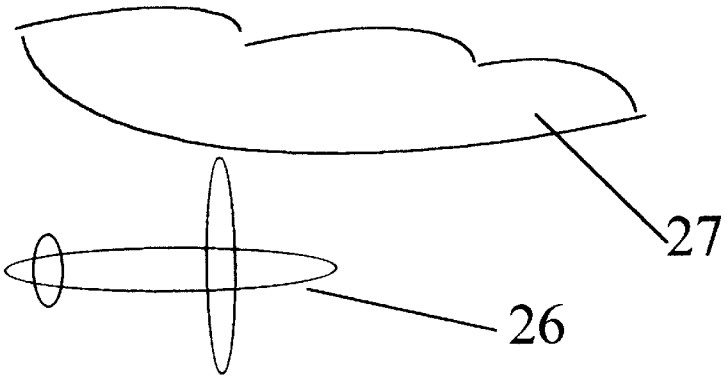
FIG. 3B is a version of the Identifiable Toy Object shapes.
Figure 3C:
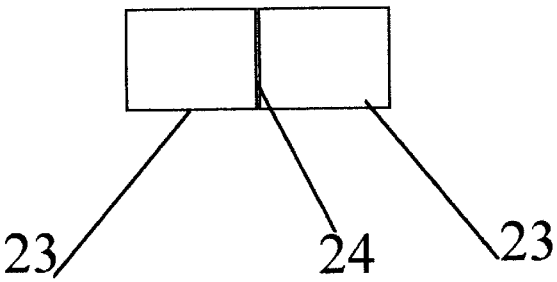
FIG. 3C is a version of attacher for building Toy Object assembly.

With respect to FIGS. 1, 2 and 3, the Toy Object has attached to it a system of weights called Balance Weights (17) to achieve close to perfect balance from substantial balance. The Balance Weight may consist of a first balance weight (18) secured to the object body, and a second balance weight (19) secured to the object body, wherein the first balance weight has a different mass than the second balance weight, the balance weights adjusting the downward force on the object body so that the upward buoyancy force on the object body is substantially equal to the downward force on the object body, thereby allowing the object body and the balance weights to float.

The Balance Weights may be self adhesive strips that are adhesible to the Toy Object and are preferably made of same material as the body of the Toy Object. The Balance Weights may be made of a series of graduated weights (20). that would allow a weight required to create close to perfect balance to be precisely created. For example, if the weight required to create close to perfect balance is 133 units, one may use weight strips of 100 unit, 20 unit, 10 unit, 2 unit and one unit. Or one may use two strips of 50 units, two strips of 10 units, two strips of 5 units, and three strips of one unit.

The system of weights may also include Orientation Weights (21). The Toy Object having preferably attached to it a Orientation Weight to maintain a desired orientation in space of the Toy Object. The orientation weight is secured to the object body and floating with the object body and is adapted to rotate the object body to properly orient the object body. The Orientation Weight on the Toy Object would tend to make the Orientation Weight part lowest point in space due to gravity acting on the Orientation Weight. The Orientation Weight, preferably, are self adhesive circular shaped disks (22) of graduated weight. Multiple Orientation weights may also be used depending on the shape and size of the toy object body.

Building a larger Toy Object structure made of generic smaller building block Toy Objects is possible. A toy assembly including a pair of toy objects (23) and an attacher (24) which is adapted to attach the pair of toy objects together is shown. The attacher also being adapted to float with the toy objects. Toy Objects are attached to each other preferably by a soft adhesive. Such soft adhesive are commonly used in the industry. Soft adhesives are commercially available and used in commercially available products, an example is Post It Notes from 3M company. Such soft adhesive enables the toy objects to be selectively and detachably attached to each other. The attacher may also be in the form of a tape with sticky glue on both sides of the tape.

The toy object body may have many different shapes. The toy object body is shaped substantially similar to a building block (25). It may have shapes that support the building block concept such as cubes, cylinders, rings etc. It may also have identifiable shapes such as body is shaped substantially similar to an airplane (26) and shaped substantially similar to a cloud (27).

Figure 4:
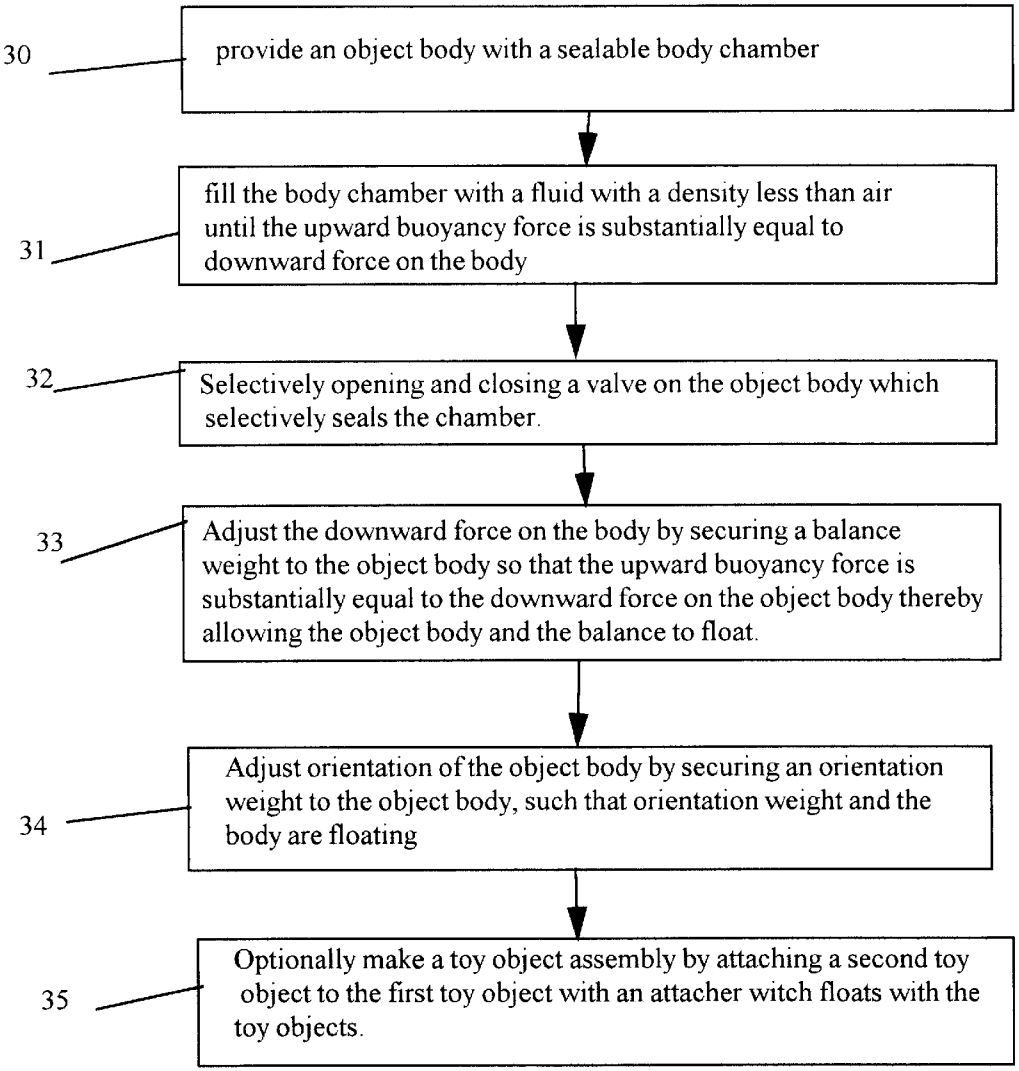
FIG. 4 is a method of manufacturing block diagram.
Figure 5:
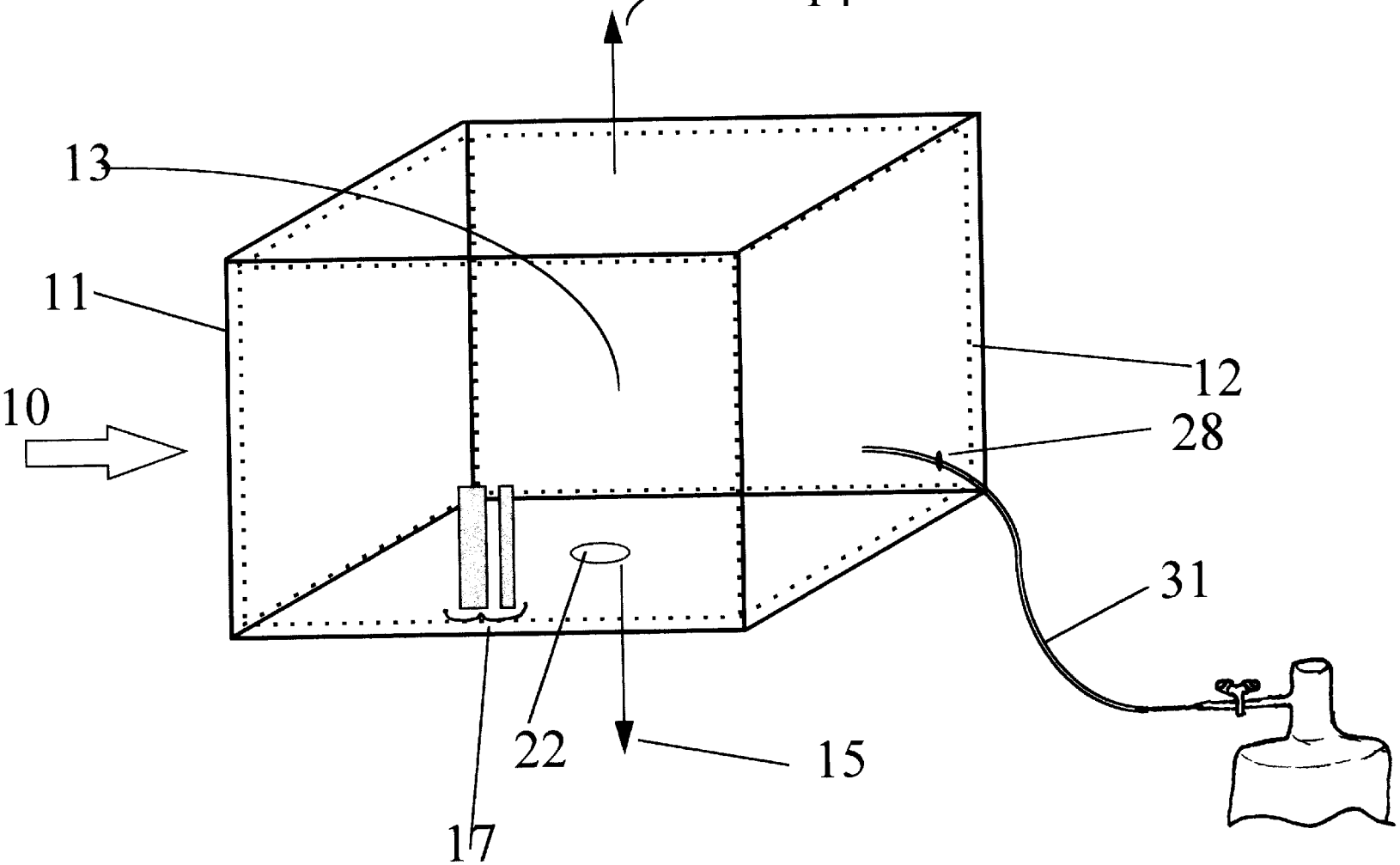
FIG. 5 is method of manufacture.

With reference to FIGS. 4 and 5, the Toy Objects may be sold as inflated and sealed at the factory or they may be sold as inflatable weight less Toy Object with a valve (28) which is adapted for selectively filling the body chamber with the fluid. The valve (28) in the skin of the Toy Object body enables the users to inflate the Toy Object with lighter than air fluid inside the object, in an amount sufficient to substantially balance upward buoyancy force with the downward gravitational force of the Toy Object.

A method of manufacturing the Toy Object consists of the steps of: providing an object body defining a body chamber (30); filling the body chamber, with a fluid (31) having a density which is less than air until an upward buoyancy force caused by the fluid on the body is substantially equal to the downward force on the object body, thereby allowing the object body to be suspended/float in the air without an external attachment. The step of filling (32) the body chamber with a fluid includes selectively opening and closing a valve (28) which selectively seals the body chamber.

The further steps of adjusting the downward force on the object body (33) by securing a balance weight to the object body so that the upward buoyancy force on the object body is substantially equal to the downward force on the object body, thereby allowing the object body and the balance weight to float.

The further step (34) of adjusting the orientation of the toy object by ecuring an orientation weight to the object body, wherein the orientation weight floats with the object body.

The further step (35) of attaching a second toy object to the first toy object with an attacher which floats with the toy objects.

Although the present invention has been described in considerable detail with respect to certain preferred versions thereof, other versions are possible. Therefore, the spirit and scope of the appended claims should not be limited to the descriptions of the preferred versions contained herein.

What is claimed is:

1. A toy object comprising:

an object body which defines a sealable body chamber, the object body including a skin having an integrally formed inner layer and outer layer, the outer layer being substantially non-stretchable; and a fluid disposed In the body chamber, the fluid having a density which is less than the density of air; wherein the amount of the fluid in the body chamber is sufficient so that the upward buoyancy force caused by the fluid on the body is substantially equal to the downward force on the object body thereby allowing the object body to float in the air without an external attachment.

2. The toy object of claim 1 including a first balance weight secured to the object body, the first balance weight adjusting the downward force on the object body so that the upward buoyancy force on the object body is substantially equal to the downward force on the object body, thereby allowing the object body and the first balance weight to float.

3. The toy object of claim 2 including a second balance weight secured to the object body, the first balance weight adjusting the downward force on the object body so that the upward buoyancy force on the object body is substantially equal to the downward force on the object body, thereby allowing the object body and the balance weights to float.

4. The toy object of claim 3 wherein the first balance weight has a different mass than the second balance weight.

5. The toy object of claim 1 including an orientation weight secured to the object body and floating with the object body, the orientation weight being adapted to rotate the object body to properly orient the object body.

6. The toy object of claim 1 including a valve which is adapted for selectively filling the body chamber with the fluid.

7. The toy object of claim 1 wherein the object body is shaped substantially similar to an airplane.

8. The toy object of claim 1 wherein the object body is shaped substantially similar to a cloud.

9. The toy object of claim 1 wherein the object body is shaped substantially similar to a building block.

10. A toy assembly including a pair of toy objects of claim 1 and an attacher which is adapted to attach the pair of toy objects together, the attacher also being adapted to float with the toy objects.

11. The toy assembly of claim 10 wherein the attacher is adapted to selectively and detachable attach the pair of toy objects together.

12. The toy object of claim 1 wherein the inner layer is gas impermeable.

13. A toy object comprising:

an object body defining a sealable body chamber, the object body including a skin having an integrally formed inner layer and outer layer, the inner layer being gas impermeable, the outer layer being substantially non-stretchable;

a fluid disposed in the body chamber, the fluid having a density which is less than the density of air; wherein the amount of the fluid in the body chamber is sufficient so that the upward buoyancy force caused by the fluid on the body is substantially equal to the downward force on the object body thereby allowing the object body to float in the air without an external attachment; and a balance weight adapted to be selectively secured to the object body to adjust the downward force on the object body so that the upward buoyancy force on the object body is substantially equal to the downward force on the object body, thereby allowing the object body and the balance weight to float.

14. The toy assembly of claim 13 further comprising a plurality of balance weights, each of the balance weights having a different mass.

15. The toy object of claim 13 including an orientation weight secured to the object body and floating with the object body, the orientation weight being adapted to rotate the object body to properly orient the object body.

16. The toy object of claim 13 including a valve which is adapted for selectively filling the body chamber with the fluid.

17. A toy assembly of claim 13 including a pair of the toy objects and an attacher which is adapted to attach the pair of toy objects together, the attacher also being adapted to float with the toy objects.

18. A method of manufacturing a toy object, the method comprising the steps of:

providing an object body defining a sealable body chamber, the object body including a skin having an integrally formed inner layer and outer layer, the inner layer being gas impermeable, the outer layer being substantially non-stretchable; and filling the body chamber, with a fluid having a density which is less than air until an upward buoyancy force caused by the fluid on the object body is substantially equal to the downward force on the object body, thereby allowing the object body to float in the air without an external attachment.

19. The method of claim 18 further comprising the steps of adjusting the downward force on the object body by securing a balance weight to the object body so that the upward buoyancy force on the object body is substantially equal to the downward force on the object body, thereby allowing the object body and the balance weight to float.

20. The method of claim 18 further comprising the steps of adjusting the orientation of the toy object by securing an orientation weight to the object body, wherein the orientation weight floats with the object body.

21. The method of claim 18, wherein the step of filling the body chamber with a fluid includes selectively opening and closing a valve which selectively seals the body chamber.

22. The method of claim 18 further comprising the step of attaching a second toy object to the first toy object with an attacher which floats with the toy objects.

* * * * *